US008033256B2

(12) United States Patent
Takahashi et al.

(10) Patent No.: US 8,033,256 B2
(45) Date of Patent: Oct. 11, 2011

(54) ENGINE HAVING VARIABLE VALVE MECHANISM

(75) Inventors: Toshihiko Takahashi, Shizuoka (JP); Kazuya Koike, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 211 days.

(21) Appl. No.: 12/372,798

(22) Filed: Feb. 18, 2009

(65) Prior Publication Data

US 2009/0205598 A1 Aug. 20, 2009

(30) Foreign Application Priority Data

Feb. 19, 2008 (JP) ..... 2008-037656

(51) Int. Cl.
*F01L 1/34* (2006.01)

(52) U.S. Cl. ..... 123/90.16; 123/90.39; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS

| | | | |
|---|---|---|---|
| 5,515,820 | A | 5/1996 | Sugimoto et al. |
| 6,481,398 | B2 | 11/2002 | Uchiyama |

FOREIGN PATENT DOCUMENTS

| | | | |
|---|---|---|---|
| EP | 0 258 061 | A1 | 3/1988 |
| EP | 0 703 357 | A2 | 3/1996 |
| EP | 1 247 945 | A2 | 10/2002 |
| EP | 1 728 976 | A1 | 12/2006 |
| GB | 2 230 818 | A | 10/1990 |
| JP | 10-18826 | A | 1/1998 |
| JP | 2002-303109 | A | 10/2002 |
| JP | 2003-41915 | A | 3/2003 |

OTHER PUBLICATIONS

Official Communication issued in corresponding European Patent Application No. 09002269.0 mailed on Aug. 18, 2009.

*Primary Examiner* — Ching Chang
(74) *Attorney, Agent, or Firm* — Keating & Bennett, LLP

(57) ABSTRACT

An engine having a variable valve mechanism arranged to switch a lift degree of a valve between a low speed state and a high speed state includes a cam carrier defined by a cam bearing portion, a rocker shaft support, and a hydraulic cylinder support. The cam bearing portion is provided on a line passing through the bore center of a cylinder in a plane perpendicular or substantially perpendicular to the camshaft. The low speed rocker arm swings in response to the low speed cam of the camshaft. The high speed rocker arm swings in response to the high speed cam of the camshaft. The low speed rocker arm includes a through hole. A connecting pin is slidably inserted into the through hole and urged toward the hydraulic cylinder support. A hydraulic cylinder is provided in the hydraulic cylinder support.

8 Claims, 8 Drawing Sheets

ENGINE HAVING VARIABLE VALVE MECHANISM

BACKGROUND OF THE INVENTION

1. Field of the Invention

The present invention relates to an engine, and more specifically to an engine having a variable valve mechanism arranged to switch a lift degree of a valve between a high speed state and a low speed state.

2. Description of the Background Art

JP 2002-303109 discloses a speed range selectable valve mechanism for an internal combustion engine. In this valve mechanism, a camshaft includes low and high cam noses, and a valve supported at a cylinder head is selectively engaged with one of the high and low cam noses by the cam-linkage, which allows the valve to be opened or closed according to the high and low speed ranges of the internal combustion engine. First and second rocker arms are pivotally supported at the cylinder head. The swinging end of the first rocker arm and the low cam nose are engaged with each other by the cam-linkage, and the swinging end of the second rocker arm and the high cam nose are engaged with each other by the cam-linkage. A columnar engaging member (connecting pin) is supported at the first rocker arm so that it can slide therein in a reciprocating manner. The engaging member slides and projects from the side of the first rocker arm to the side of the second rocker arm in such a manner that it can advance/withdraw. This allows the first and second rocker arms to be detachably engaged with each other. The cylinder head is provided with a hydraulic actuator that applies an external force upon the engaging member against the energizing force of an engagement releasing spring. The actuator includes a cylinder hole (hydraulic cylinder) formed at the cylinder head and a piston (hydraulic piston) snugly inserted into the cylinder hole so that the piston can slide in the hole in a reciprocating manner. The cylinder hole leads to the hydraulic pump through an oil passage. The oil passage is formed at the cylinder head. A coil-shaped rocker arm spring (lost motion spring) is fitted onto the pivotal shaft of the rocker arm and the spring urges the second rocker arm so that the second rocker arm and the high cam nose are engaged with each other by the cam-linkage.

The hydraulic actuator is provided between the valve springs in the valve mechanism but the spacing between the valve springs is small in a small size engine and therefore there is little free space. Since the cylinder hole (hydraulic cylinder) is formed at the cylinder head, it is difficult to form the cylinder holes with high precision in a multi-cylinder engine. It is also difficult to assemble the piston of the hydraulic actuator and the rocker arm. In addition, the complicated oil passage is difficult to form.

JP 10-18826 A discloses a variable mechanism capable of carrying out various kinds of switching about the opening/closing timing, the lift degree, and the stopping timing for intake or exhaust valves in an internal combustion engine. In the variable valve mechanism, five supports are attached in such locations that they hold the four cylinders among them, and a rocker shaft is inserted through these supports. One T-shaped low speed rocker arm is swingably provided at the rocker shaft for each cylinder. A camshaft is rotatably supported at each support, and a low speed cam used to swing the low speed rocker arm is provided at the camshaft. The variable valve mechanism includes a switching device used to switch the opening/closing timing and lift degree of a valve between two stages, i.e., the high speed state and the low speed state. The switching device includes a high speed rocker arm that is adjacent to the low speed rocker arm, swingably provided at the rocker shaft and does not directly push the valve, a high speed cam that swings the high speed rocker arm, and a hydraulic piston driving a switch pin that connects or disconnects the high speed rocker arm and the low speed rocker arm between each other.

However, the low speed rocker arm in the valve mechanism pushes two valves together in the same cylinder and therefore different lift degrees cannot be set for these valves. In addition, the low speed rocker arm is provided at the bore center and therefore the camshaft cannot be supported at the bore center. Therefore, the supporting rigidity of the camshaft is low and the valve mechanism is not suitable for high speed engines.

SUMMARY OF THE INVENTION

In order to overcome the problems described above, preferred embodiments of the present invention provide an engine having a camshaft with high supporting rigidity and a variable valve mechanism that can easily be assembled.

An engine according to a preferred embodiment of the present invention has a variable valve mechanism arranged to switch a lift degree of a valve between a low speed state and a high speed state and includes a cam carrier, a rocker shaft, a low speed rocker arm, a high speed rocker arm, and a switching device. The cam carrier includes a cam bearing portion and a rocker shaft support. The cam bearing portion is provided on a straight line passing through a bore center of a cylinder in a plane that is perpendicular or substantially perpendicular to a camshaft and supports the camshaft. The cam carrier is detachably provided at a cylinder head. The rocker shaft is arranged parallel or substantially parallel with the camshaft at the rocker shaft support. The low speed rocker arm is swingably supported by the rocker shaft and swings according to the low speed cam of the camshaft to push a stem end surface of the valve. The high speed rocker arm is swingably supported by the rocker shaft, aligned with the low speed rocker arm and swings according to the high speed cam of the camshaft. The switching device is arranged to disconnect the low speed rocker arm and the high speed rocker arm in the low speed state and connect the low speed rocker arm and the high speed rocker arm in the high speed state.

According to a preferred embodiment of the present invention, the cam bearing portion of the cam carrier is provided at the bore center, and not only the cam bearing portion but also the rocker shaft support that supports the rocker shaft is provided at the cam carrier, so that the supporting rigidity of the camshaft may be maintained highly while the engine may be easily assembled.

According to a preferred embodiment of the present invention, the low speed rocker arm includes a through hole arranged parallel or substantially parallel with the rocker shaft. The cam carrier further includes a hydraulic cylinder support. The switching device includes a connecting pin, a hydraulic cylinder, and a hydraulic piston. The connecting pin is slidably inserted into the through hole and urged toward the hydraulic cylinder support. The hydraulic cylinder is provided in the hydraulic cylinder support. The hydraulic piston is slidably inserted into the hydraulic cylinder and abutted against the connecting pin. The high speed rocker arm includes an engagement portion that is engaged with the connecting pin projecting from the through hole. The hydraulic cylinder may be snugly inserted into a hole arranged in the cam bearing portion, while the hole itself may be used as a hydraulic cylinder. More specifically, the hydraulic cylinder may be provided either separately from or integrally with the cam bearing portion.

In this way, the hydraulic cylinder and the hydraulic piston are provided in the cam bearing portion so that the engine can be reduced in size.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
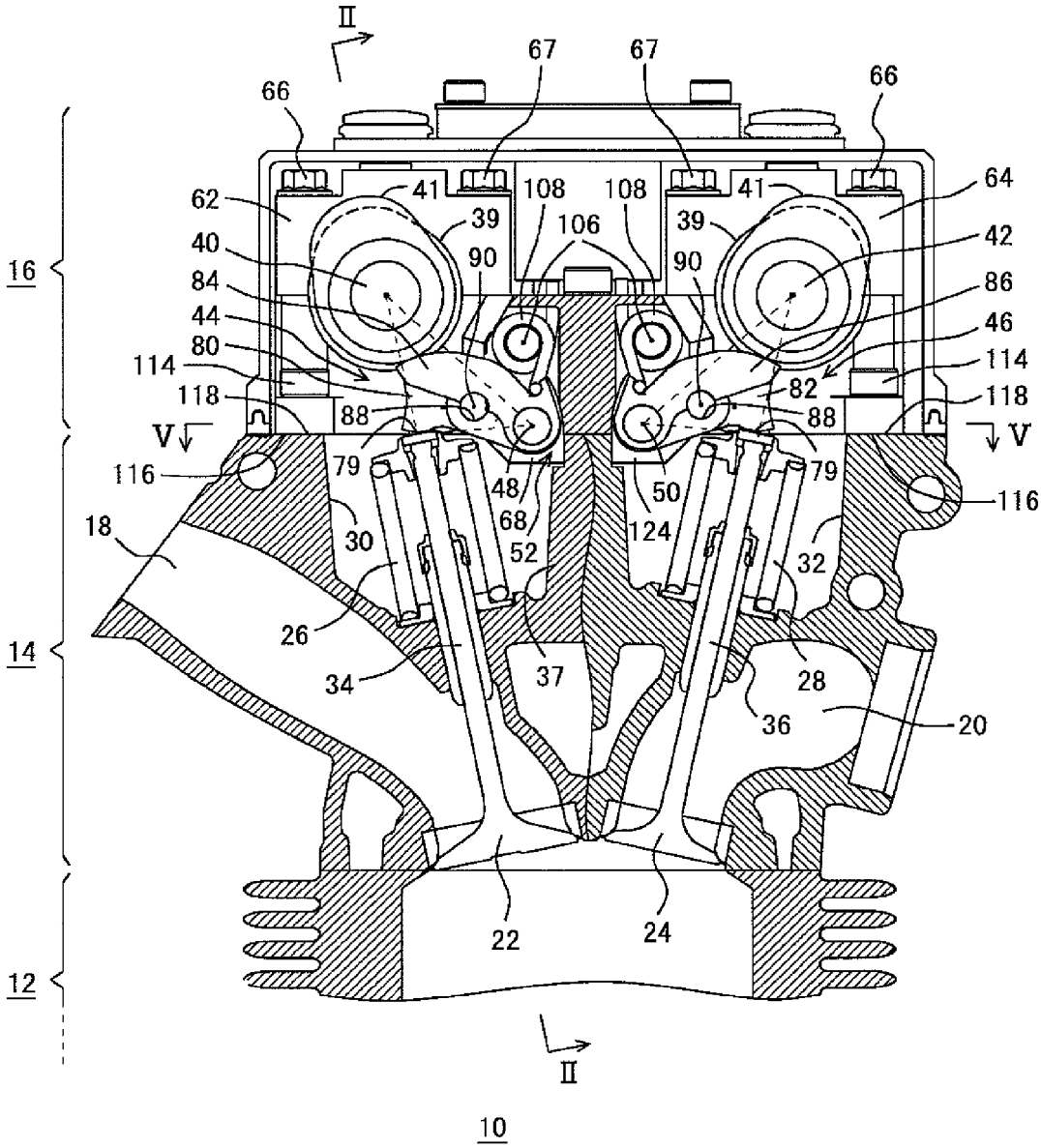
FIG. 1 is a sectional view of an engine according to a preferred embodiment of the present invention.

Preferred embodiments of the present invention will be described in detail with reference to the accompanying drawings, in which the same or corresponding elements are designated by the same reference characters, and their description will not be repeated.

Figure 2:
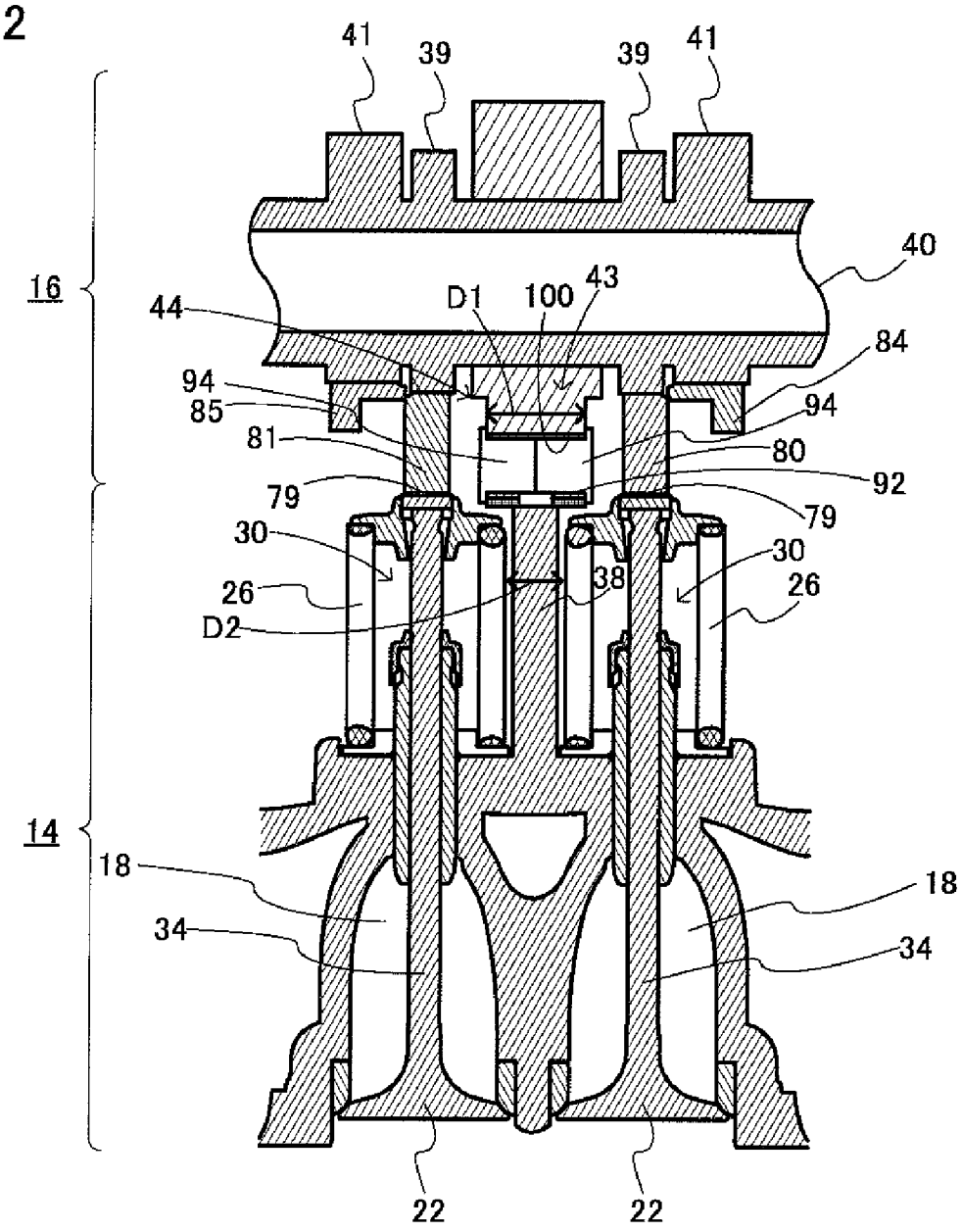
FIG. 2 is a sectional view taken along line II-II in FIG. 1.
Figure 3:
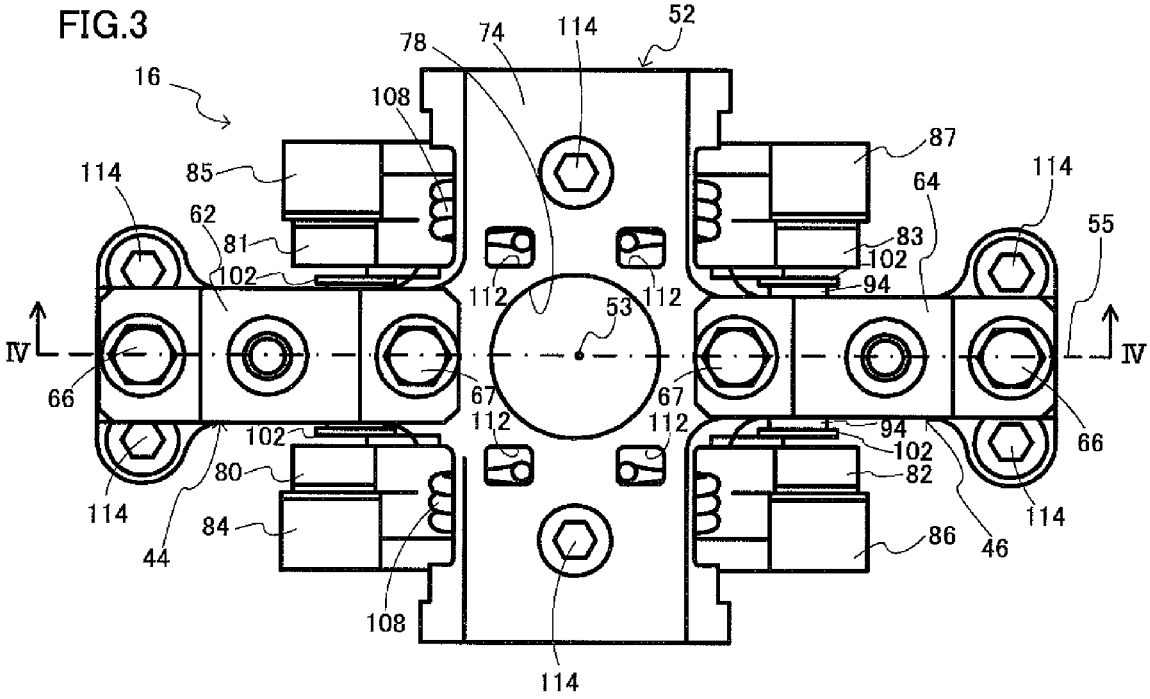
FIG. 3 is a plan view of the cam carrier and various components assembled thereinto shown in FIG. 1.
Figure 4:
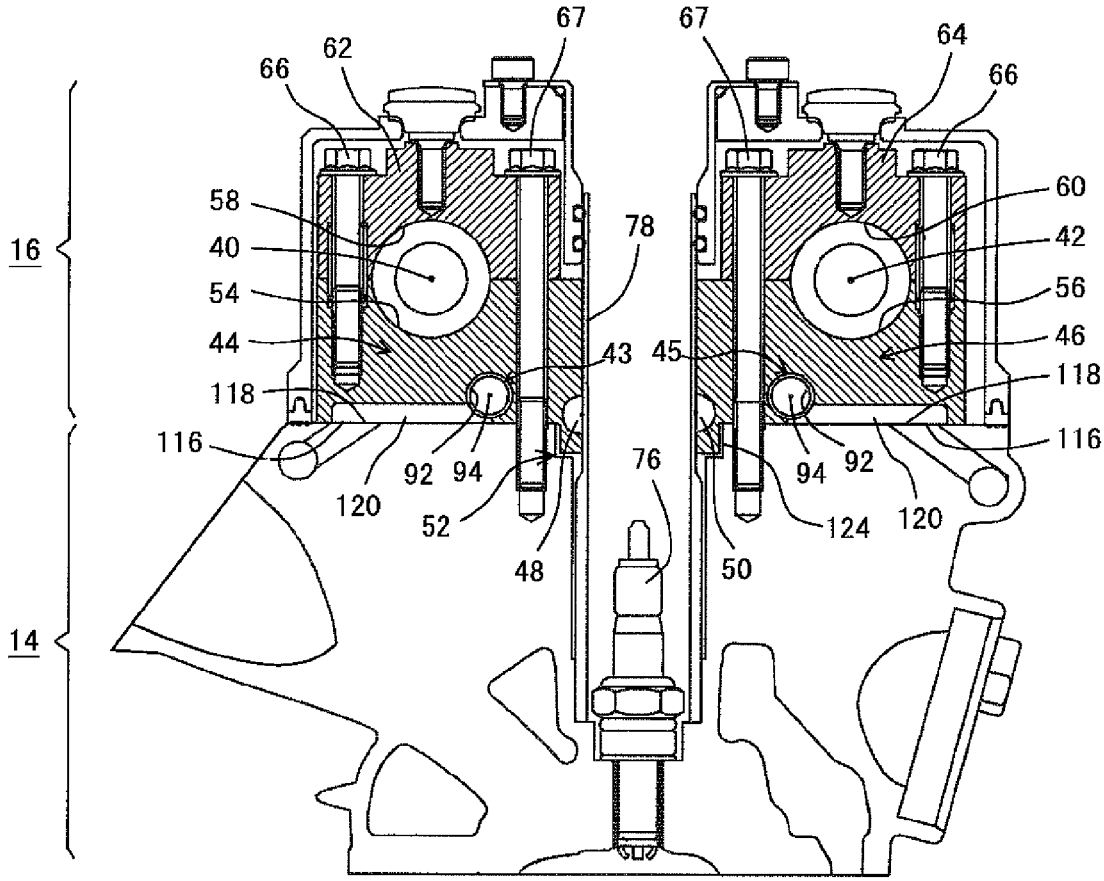
FIG. 4 is a sectional view taken along line IV-IV in FIG. 3.
Figure 5:
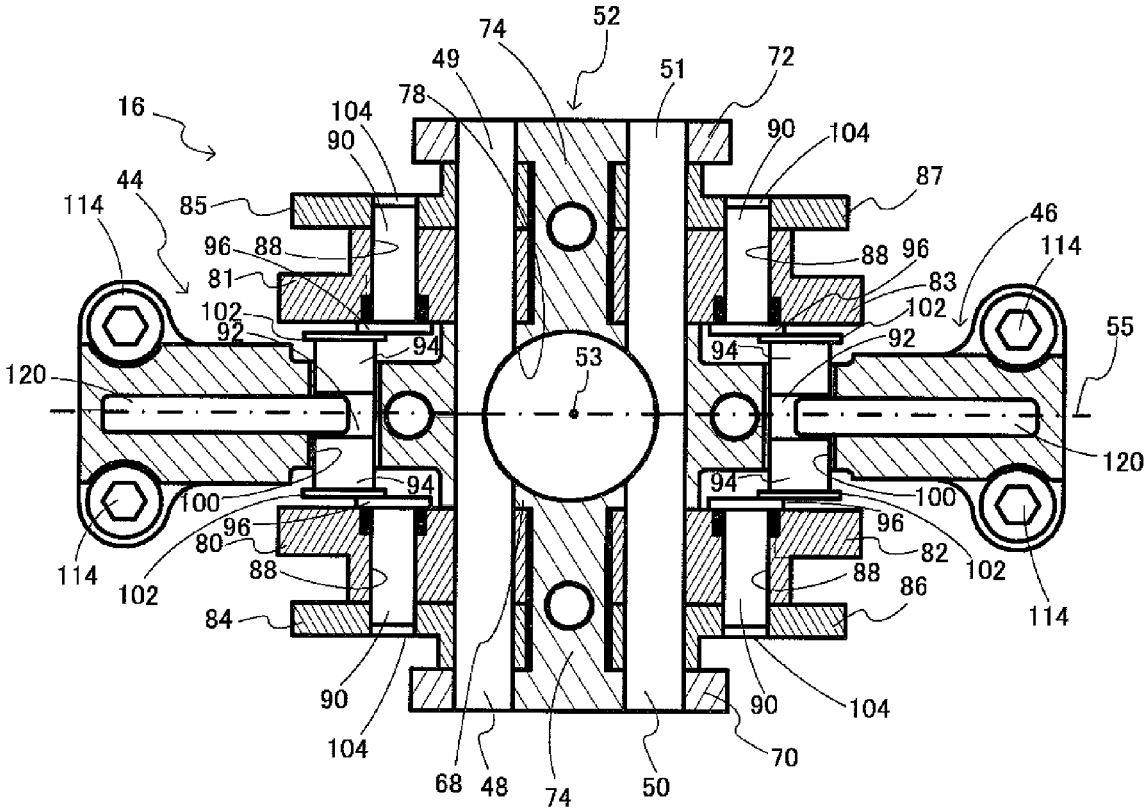
FIG. 5 is a sectional view taken along line V-V in FIG. 1.
Figure 6:
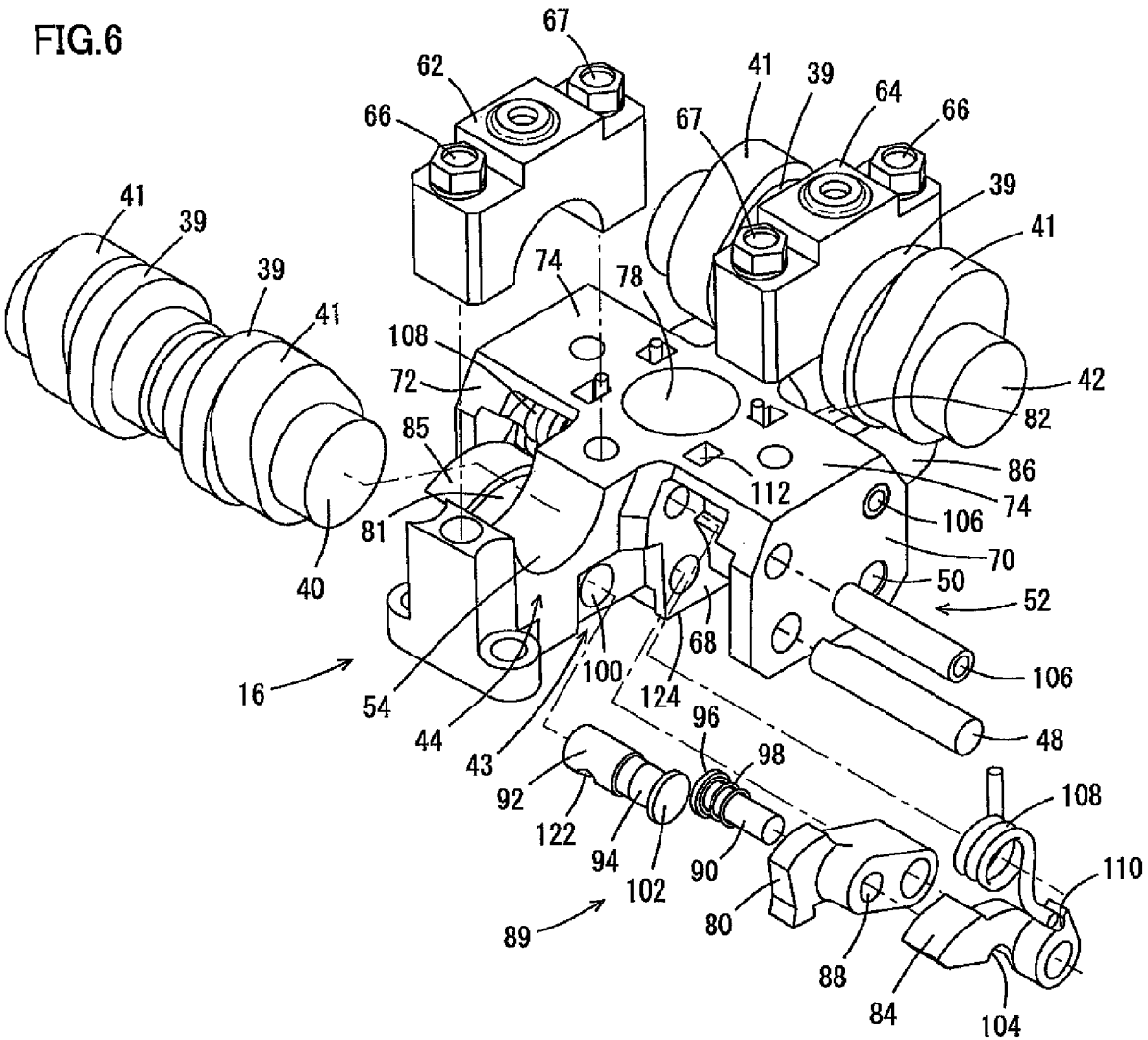
FIG. 6 is an exploded perspective view of the cam carrier and various components assembled thereinto shown in FIG. 1.
Figure 7:
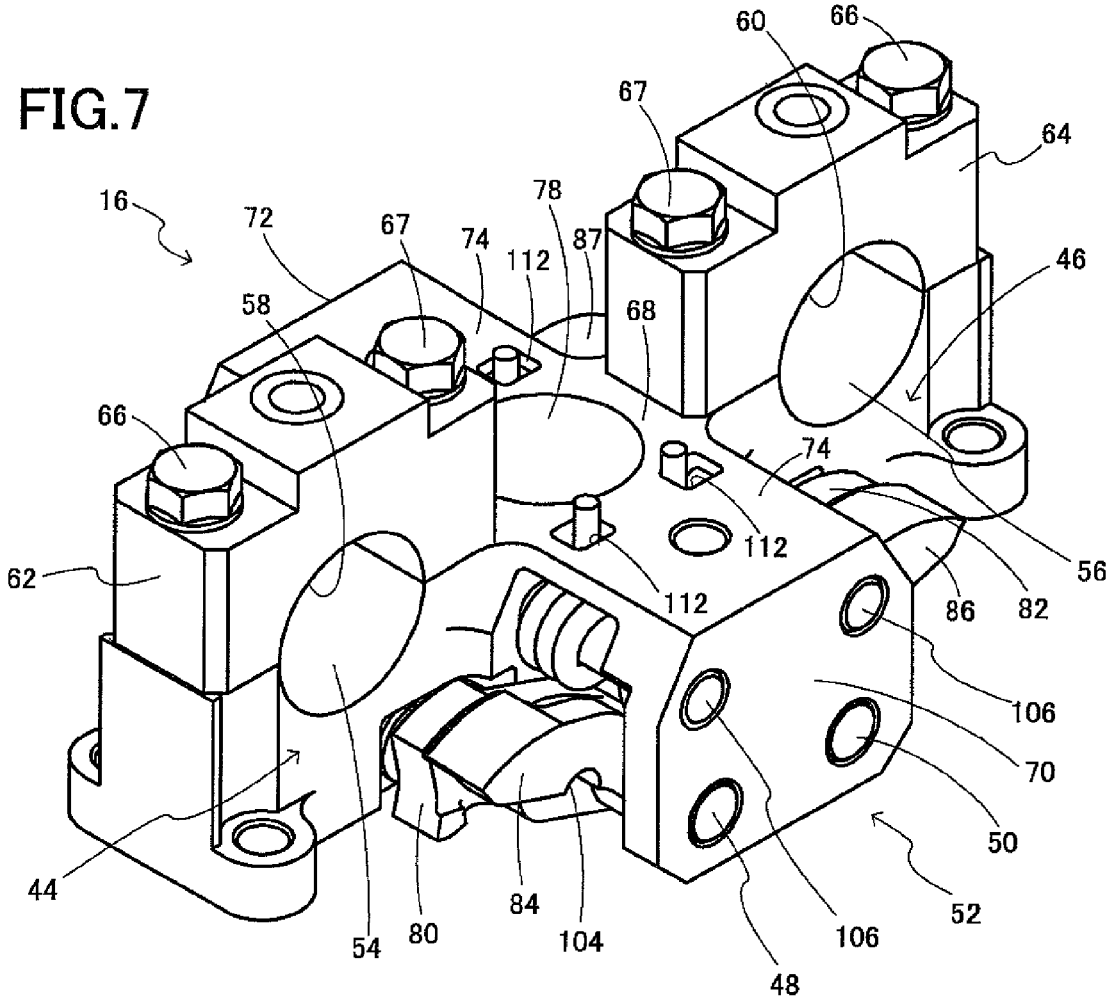
FIG. 7 is a perspective view of the cam carrier and various components assembled thereinto shown in FIG. 6.
Figure 8:
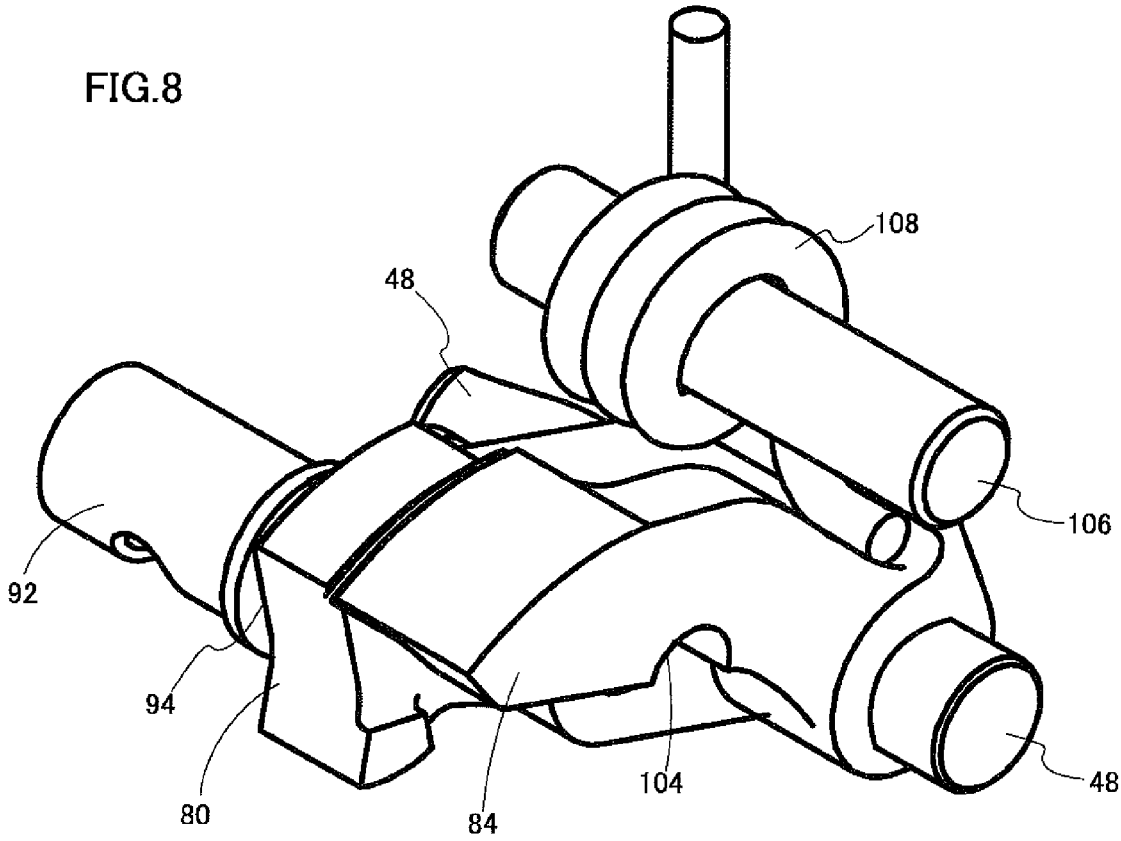
FIG. 8 is a perspective view of the low speed rocker arm, the high speed rocker arm, the rocker shaft, the lost motion spring, the lost motion spring shaft, the connecting pin, the hydraulic piston, and the hydraulic cylinder shown in FIG. 7.

FIG. 1 is a sectional view of an engine according to a preferred embodiment of the present invention. FIG. 2 is a sectional view taken along line II-II in FIG. 1. FIG. 3 is a plan view of the cam carrier and various components assembled thereinto shown in FIG. 1. FIG. 4 is a sectional view taken along line IV-IV in FIG. 3. FIG. 5 is a sectional view taken along line V-V in FIG. 1. FIG. 6 is an exploded perspective view of the cam carrier and various components assembled thereinto shown in FIG. 1. FIG. 7 is a perspective view of the cam carrier shown in FIG. 6 and various elements assembled thereinto. FIG. 8 is a perspective view of the low speed rocker arm, the high speed rocker arm, the rocker shaft, the lost motion spring, the lost motion spring shaft, the connecting pin, the hydraulic piston, and the hydraulic cylinder shown in FIG. 7.

The DOHC (Double Over Head Camshaft) engine according to a preferred embodiment of the present invention includes a variable valve mechanism that switches the lift degrees of the intake and exhaust valves between two stages, i.e., a low speed state and a high speed state. More specifically, with reference to FIGS. 1 and 2, the engine 10 includes a cylinder 12, a cylinder head 14 detachably connected to the cylinder 12, and a cam carrier 16 detachably connected to the cylinder head 14. If, for example, the engine is a four-cylinder engine, four cylinders 12 are arranged in series. In the engine 10, the structure is preferably the same for each cylinder. A preferred embodiment will be described in the following paragraphs with reference to one cylinder.

With reference to FIG. 1, the cylinder head 14 includes an intake port 18, an exhaust port 20, an intake valve 22, an exhaust valve 24, valve springs 26 and 28, and valve spring storing spaces 30 and 32. The engine is a four-valve type engine with two intake valves 22 and two exhaust valves 24. Valve springs 26 and 28 are wound around rods 34 and 36 of the intake and exhaust valves 22 and 24 and stored in the valve spring storing spaces 30 and 32, respectively. A partition wall 37 is defined between the valve spring storing space 30 on the intake side and the valve spring storing space 32 on the exhaust side. With reference to FIG. 2, a partition wall 38 is defined between the two valve spring storing spaces 30 on the intake side. While the arrangement is the same as FIG. 2 and therefore is not shown, a partition wall is also defined between the two valve spring storing spaces 32 on the exhaust side. The partition walls 38 in this example each preferably have the same thickness in any of the locations, but the thickness may be different among the locations.

With reference to FIGS. 1 and 3 to 7, the cam carrier 16 includes cam bearing portions 44 and 46 that rotatably support two camshafts 40 and 42, respectively, a rocker shaft support 52 that supports rocker shafts 48 to 51, and hydraulic cylinder supports 43 and 45. The cam bearing portions 44 and 46, the rocker shaft support 52, and the hydraulic cylinder supports 43 and 45 are integral. With reference to FIGS. 3 and 5, the cam bearing portions 44 and 46 are aligned on a straight line 55 that passes a bore center (the center of the cylinder 12) 53 in a plane perpendicular or substantially perpendicular to the camshafts 40 and 42. The cam carrier 16 is separately arranged for each of the cylinders. Therefore, in the four-cylinder engine, four such cam carriers 16 are provided. The camshafts 40 and 42 are supported commonly by the four cam carriers 16 that are aligned.

With reference to FIGS. 6 and 7, the cam bearing portions 44 and 46 have semi-circular or substantially semi-circular cutouts 54 and 56, respectively, and the camshafts 40 and 42 are laid on the cutouts. The camshafts 40 and 42 each have a low speed cam 39 with a small displacement and a high speed cam 41 with a large displacement. Holders 62 and 64 having cutouts 58 and 60 that are symmetrical to the cutouts 54 and 56 are attached to the cam bearing portions 44 and 46 by bolts 66 and 67 so that the camshafts 40 and 42 are held between them. In this way, the camshafts 40 and 42 are rotatably supported.

With reference to FIGS. 3 to 7, the rocker shaft support 52 includes a rectangular or substantially rectangular shaped central portion 68, flat ends 70 and 72, and a connecting portion 74 that connects the central portion 68 and the end portions 70 and 72. The central portion 68 has a through hole 78 through which an ignition plug 76 can be attached/detached to/from the cylinder head 14. The rocker shafts 48 to 51 are attached to the rocker shaft support 52 in parallel or substantially parallel with the camshafts 40 and 42. Four of such rocker shafts 48 to 51 are provided corresponding to the four valves 22 and 24. More specifically, the rocker shafts 48 and 50 bridge between the central portion 68 and the end portion 70. The rocker shafts 49 and 51 bridge between the central portion 68 and the end portion 72. The rocker shafts 48 and 50 are abutted against the rocker shafts 49 and 51, respectively, in the central portion 68. In the central portion 68, the rocker shafts 48 to 51 each have a portion cut away in a circular or substantially circular shape along the through hole 78.

With reference to FIGS. 1 to 7, low speed rocker arms 80 to 83 are swingably supported by the rocker shafts 48 to 51. The four low speed rocker arms 80 to 83 are provided to correspond to the four valves 22 and 24. The tip ends of the low speed rocker arms 80 to 83 push the stem end surfaces 79 of the intake and exhaust valves 22 and 24. The low speed rocker arms 80 and 81 swing according to the low speed cam 39 of the camshaft 40 on the intake side and thus directly push the intake valves 22. The low speed rocker arms 82 and 83 swing according to the low speed cam 39 of the camshaft 42 on the exhaust side and thus directly push the exhaust valves 24.

High speed rocker arms 84 to 87 are swingably supported by the rocker shafts 48 to 51. The four high speed rocker arms 84 to 87 are provided corresponding to the four valves 22 and 24. The high speed rocker arms 84 to 87 are provided adjacent to the low speed rocker arms 80 to 83, respectively. The high speed rocker arms 84 and 85 swing according to the high speed cam 41 of the camshaft 40 on the intake side. The high speed rocker arms 84 and 85 do not directly push the intake valves 22. The high speed rocker arms 86 and 87 swing according to the high speed cam 41 of the camshaft 42 on the exhaust side. The high speed rocker arms 86 and 87 do not directly push the exhaust valves 24.

With reference to FIGS. 5 and 6, the low speed rocker arms 80 to 83 are provided more on the side of the cam bearing portions 44 and 46 than the high speed rocker arms 84 to 87 and each have a circular or substantially circular through hole 88. The through holes 88 are arranged parallel or substantially parallel to the rocker shafts 48 to 51.

With reference to FIG. 6, the engine 10 further includes a switching device 89 that disconnects the low speed rocker arms 80 to 83 and the high speed rocker arms 84 to 87 in a low speed state and connects the low speed rocker arms 80 to 83 and the high speed rocker arms 84 to 87 in a high speed state.

More specifically, with reference to FIGS. 2, 5, and 6, the switching device 89 includes a columnar connecting pin 90, a cylindrical hydraulic cylinder 92, a columnar hydraulic piston 94, and a spring 98.

The connecting pin 90 has a circular or substantially circular rim 96 at its head. The connecting pin 90 has the spring 98 wound therearound. The connecting pin 90 is slidably inserted into the through hole 88 from its bottom. The connecting pin 90 is therefore urged toward the hydraulic cylinder supports 43 and 45. The connecting pin 90 is longer than the through hole 88. Therefore, when the connecting pin 90 is thoroughly inserted into the through hole 88, the bottom of the connecting pin 90 projects from the opposite end of the through hole 88.

The hydraulic cylinder 92 is provided in each of the hydraulic cylinder supports 43 and 45. More specifically, a circular through hole 100 is arranged under each of the cutouts 54 and 56 of the cam bearing portions 44 and 46. The hydraulic cylinder 92 is snugly inserted into the through hole 100 and fixed in the hydraulic cylinder supports 43 and 45.

In this example, the through hole 100 of the hydraulic cylinder 92 is perforated in the hydraulic cylinder supports 43 and 45 and then the hydraulic cylinder 92 is inserted snugly into the through hole 100, while the through hole 100 itself may be used as a hydraulic cylinder without fitting any element in the through hole 100.

In addition, hydraulic pistons 94 on both sides are inserted into the hydraulic cylinders 92 inserted snugly in the common through holes 100 in this example, but two independent non-penetrating holes having different axial centers may be perforated from both sides of the hydraulic cylinder supports and then the hydraulic cylinders may be inserted into the non-penetrating holes. In this case, the hydraulic cylinders are aligned in the direction perpendicular or substantially perpendicular to the camshaft, so that the width of the hydraulic cylinder supports can further be narrowed.

The hydraulic piston 94 has a circular or substantially circular rim 102 at its head. The hydraulic piston 94 is slidably inserted into the hydraulic cylinder 92 from its bottom. The head (rim 102) of the hydraulic piston 94 is abutted against the head (rim 96) of the connecting pin 90.

In this way, the hydraulic cylinders 92 and the hydraulic pistons 94 are provided under the cam bearing portions 44 and 46, and therefore the switching device 89 can be compactly mounted in a small engine with a narrow inter-valve spring distance. In this example, as shown in FIG. 2, the hydraulic cylinder supports 43 and 45 are wider than the distance between the two valve springs 26 on the intake side. More specifically, the thickness D1 of the hydraulic cylinder supports 43 in the axial direction of the camshafts 40 and 42 is larger than the distance D2 between the outer circumferences of the valve springs 26.

With reference to FIGS. 5 to 8, the high speed rocker arms 84 to 87 each have an engagement portion 104 that is engaged with the bottom of the connecting pin 90 projecting from the through hole 88. The engagement portion 104 is preferably a semi-circular or substantially semi-circular cutout and the connecting pin 90 is engaged with the cutout.

With reference to FIGS. 1 and 6 to 8, the rocker shaft support 52 is provided with a lost-motion spring shaft 106 arranged in parallel or substantially parallel with the camshafts 40 and 42. Four such lost-motion spring shafts 106 are provided corresponding to the four valves 22 and 24. More specifically, the lost-motion spring shafts 106 bridge between the central portion 68 and the end portions 70 and 72. A lost-motion spring 108 is wound around the lost-motion spring shaft 106 and latched on each of the high speed rocker arms 84 to 87 and the connecting portion 74. More specifically, the high speed rocker arms 84 to 87 each have a latch slot 110 defined by a semi-circular or substantially semi-circular shape and one end of the lost-motion spring 108 is latched there. The connecting portion 74 has a latch slot 112 cut in a rectangular or substantially rectangular shape and the other end of the lost motion spring 108 is latched there. Therefore, the high speed rocker arms 84 to 87 are urged toward the high speed cam 41.

With reference to FIG. 1, on the intake side, the axial center of the lost-motion spring shaft 106 is provided outside the range defined by connecting the axial center of the camshaft 40 on the intake side, the axial center of the rocker shaft 48, and the midpoint of the stem end surface 79 of the intake valve 22. On the exhaust side, the axial center of the lost motion spring shaft 106 is provided outside the range defined by connecting the axial center of the camshaft 42 on the exhaust side, the axial center of the rocker shaft 50 and the midpoint of the stem end surface 79 of the exhaust valve 24.

With reference to FIGS. 1 and 3 to 5, the cam carrier 16 is attached to the cylinder head 14 preferably by bolts 67 and 114, for example. With reference to FIGS. 4 and 5, the lower surfaces 116 of the cam bearing portions 44 and 46 are connected to the upper surface 118 of the cylinder head 14. A groove 120 in communication with the hydraulic cylinder 92 is defined at the lower surfaces 116 of the cam bearing portions 44 and 46. The groove 120 defines an oil passage. With reference to FIG. 6, the hydraulic cylinder 92 has an opening 122 in communication with the groove 120. Therefore, oil let out from a hydraulic pump (not shown) comes into the hydraulic cylinder 92 via an OCV (Oil Control Valve) (not shown) from the groove 120 through the opening 122. The groove 120 feeds oil to both sides and pushes the hydraulic pistons 94 on both sides. More specifically, the groove 120 is shared by the hydraulic pistons 94 on both sides.

The groove 120 is open to the side of the lower surface 116 and therefore it is easier to form the groove 120 rather than a hole. The groove 120 may be arranged at the upper surface 118 of the cylinder head 14 instead of at the lower surface 116 of the cam carrier 16. The groove 120 in this example is preferably straight, but it may be curved. It is easy to form grooves if their curves are complicated.

With reference to FIGS. 1, 4 and 6, the central portion 68 and the ends 70 and 72 of the rocker shaft support 52 have a projecting portion 124 that projects beyond the lower surface 116 of each of the cam bearing portions 44 and 46. The rocker shafts 48 to 51 are attached to the projecting portion 124.

In a high speed state, the OCV on the oil passage is opened to increase the oil pressure in the groove 120 and the hydraulic piston 94 is pushed to the outside. The connecting pins 90 are pushed accordingly and inserted into the through holes 88 of the low speed rocker arms 80 to 83. In this way, the bottoms of the connecting pins 90 are projected from the opposite ends of the through holes 88. The high speed rocker arms 84 to 87 are urged toward the high speed cam 41 by the lost-motion springs 108 and the engagement portions 104 are engaged with the connecting pins 90 projecting from the through holes 88. In this way, when the high speed rocker arms 84 to 87 are greatly swung according to the high speed cam 41 with a large displacement, the low speed rocker arms 80 to 83 are also greatly swung together with the high speed rocker arms 84 to 87. In response, the low speed rocker arms 80 to 83 push the intake or exhaust valves 22 and 24 by the stem end surfaces 79 and the intake or exhaust valves 22 and 24 are widely opened.

On the other hand, in a low speed state, the OCV on the oil passage is closed to decrease the oil pressure in the grooves 120 and the energizing force of the springs 98 pushes the connecting pins 90 back toward the hydraulic cylinder supports 43 and 45. In this way, the hydraulic pistons 94 are pushed into the hydraulic cylinders 92 and the bottoms of the connecting pins 90 are completely retained inside the through holes 88. Therefore, when the low speed rocker arms 80 to 83 are slightly swung according to the low speed cam 39 with a small displacement, the low speed rocker arms 80 to 83 push the intake or exhaust valves 22 and 24 by the stem end surfaces 79 and the intake or exhaust valves 22 and 24 are narrowly opened. At the time, the high speed rocker arms 84 to 87 are greatly swung according to the high speed cam 41, but the bottoms of the connecting pins 90 do not project from the through holes 88, and therefore the high speed rocker arms 84 to 87 do not push anything (idle movement).

According to this preferred embodiment, the cam bearing portions 44 and 46 are aligned on a straight line 55 passing through the bore center 53, and therefore the supporting rigidity of the camshafts 40 and 42 can be maintained in a high level. The cam bearing portions 44 and 46 as well as the rocker shaft support 52 is integral at the cam carrier 16 and after all the components are assembled to the cam carrier 16, the cam carrier 16 can be attached to the cylinder head 14, so that the assembling of the engine 10 can be easier.

The hydraulic cylinders 92 and the hydraulic pistons 94 are provided at the hydraulic cylinder supports 43 and 45 positioned under the cam bearing portions 44 and 46, and therefore the thickness D1 of the hydraulic cylinder supports 43 and 45 in the axial direction of the camshafts 40 and 42 can be larger than the distance D2 between the outer circumferences of the valve springs 26. Therefore, the hydraulic cylinders 92 and the hydraulic pistons 94 can be mounted compactly for a small engine with a narrow inter-valve spring distance.

The oil passage arranged to provide the hydraulic cylinders 92 with oil pressure is the groove 120 rather than a hole, and therefore the groove 120 can easily be formed by carrying out working of the lower surfaces 116 of the cam bearing portions 44 and 46. When die-casting is employed, the work for forming the groove is not necessary. The oil passage including the groove 120 can be simplified or shortened. Consequently, the variable valve mechanism can be reduced in size and the switching response can be improved.

Since the cam carrier 16 is arranged individually for each of the cylinders, holes for the rocker shafts 48 to 51 and the lost motion spring shaft 106 and the through hole 100 for the hydraulic cylinder 92 can be perforated for each cylinder, and various components can be assembled into the cam carrier 16 for each cylinder. In this way, the working/assembling to the cam carrier 16 is easily carried out and therefore large size equipment therefor is not necessary.

In a conventional variable valve mechanism in which the lost motion springs are wound around the rocker shafts, the low speed rocker arms, the high speed rocker arms and the lost motion springs occupy a large width in the axial direction and therefore the mechanism cannot be mounted in a small size engine. Stated differently, since the axial width is limited, the boss width of the rocker shaft portion of the rocker arm must be reduced. Therefore, the inclination of the rocker arm increases. In contrast, according to the preferred embodiments of the present invention, the axial center of the lost motion spring shaft 106 is outside the range defined by connecting the axial centers of the camshafts 40 and 42, the axial centers of the rocker shafts 48 and 50, and the midpoints of the stem end surfaces 79 of the valves 22 and 24. The lost motion springs 108 are wound around the lost motion spring shafts 106, not around the rocker shafts 48 and 50, so that the low speed rocker arms 80 to 83, the high speed rocker arms 84 to 87, and the lost motion springs 108 are less likely to interfere with one another. Therefore, the axial width occupied by these elements can be reduced and the structure can be compact and lightweight.

Furthermore, the rocker shaft support 52 has a projecting portion 124 projecting beyond the lower surfaces of the cam bearing portions 44 and 46, and the rocker shafts 48 to 51 are attached to the projecting portion 124. Therefore, if the connecting surface of the lower surfaces 116 of the cam carrier 16 and the upper surface 118 of the cylinder head 14 cannot be set low because of limitations such as the layout of the exhaust port 20, the height of the cylinder head 14 can be reduced by providing the rocker shafts 48 to 51 in a level lower than the connecting surface, so that the structure can be compact.

Since the low speed rocker arms 80 to 83, the high speed rocker arms 84 to 87, the connecting pin 90, the hydraulic piston 94 are provided for each of the intake or exhaust valves 22 and 24, different lift degrees can be set for the intake or exhaust valves 22 and 24.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An engine having a variable valve mechanism arranged to switch a lift degree of a valve between a low speed state and a high speed state, the engine comprising:

a cam carrier including a cam bearing portion provided on a straight line passing through a bore center of a cylinder in a plane perpendicular or substantially perpendicular to an axial direction of a camshaft and arranged to support the camshaft and a rocker shaft support, the cam carrier being detachably provided at a cylinder head;

a rocker shaft arranged parallel or substantially parallel to the camshaft at the rocker shaft support;

a low speed rocker arm swingably supported by the rocker shaft and arranged to swing according to a low speed cam of the camshaft to push a stem end surface of the valve;

a high speed rocker arm swingably supported by the rocker shaft, aligned with the low speed rocker arm, and arranged to swing according to a high speed cam of the camshaft; and a switching device arranged to disconnect the low speed rocker arm and the high speed rocker arm in the low speed state and connect the low speed rocker arm and the high speed rocker arm in the high speed state.

2. The engine according to claim 1, wherein the low speed rocker arm includes a through hole arranged parallel or substantially parallel to the rocker shaft;

the cam carrier further includes a hydraulic cylinder support; and the switching device comprises:

a connecting pin slidably inserted into the through hole and urged toward the hydraulic cylinder support;

a hydraulic cylinder provided in the hydraulic cylinder support; and a hydraulic piston slidably inserted into the hydraulic cylinder and abutted against the connecting pin; and the high speed rocker arm includes an engagement portion engaged with the connecting pin projecting from the through hole.

3. The engine according to claim 2, wherein the hydraulic cylinder support has a width in a direction in which the hydraulic piston slides, the width being wider than a distance between outer circumferences of intake or exhaust valve springs in the cylinder head.

4. The engine according to claim 2, wherein the cam bearing portion includes a lower surface arranged to contact an upper surface of the cylinder head, and a groove leading to the hydraulic cylinder is arranged at the lower surface of the cam bearing portion or the upper surface of the cylinder head.

5. The engine according to claim 1, wherein the cam carrier is individually arranged for each cylinder.

6. The engine according to claim 1, further comprising:

a lost motion spring shaft attached to the rocker shaft support substantially parallel to the camshaft; and a lost motion spring wound around the lost motion spring shaft and latched at the high speed rocker arm; wherein the lost motion spring shaft has an axial center positioned outside a range defined by connecting an axial center of the camshaft, an axial center of the rocker shaft, and a midpoint of a stem end surface of the valve.

7. The engine according to claim 1, wherein the rocker shaft support includes a projecting portion arranged to project beyond a lower surface of the cam bearing portion; and the rocker shaft is attached to the projecting portion.

8. The engine according to claim 1, wherein the low speed rocker arm, the high speed rocker arm, and the switching device are provided for each valve.

* * * * *